United States Patent [19]

Pitts

[11] Patent Number: 4,484,401

[45] Date of Patent: Nov. 27, 1984

[54] INSERTS FOR TRANSPARENT IDENTIFICATION TABS

[75] Inventor: Warren R. Pitts, Needham, Mass.

[73] Assignee: Dennison Manufacturing Company, Framingham, Mass.

[21] Appl. No.: 501,472

[22] Filed: Jun. 6, 1983

Related U.S. Application Data

[63] Continuation of Ser. No. 330,615, Dec. 14, 1981, abandoned.

[51] Int. Cl.[3] ..... A44C 3/00

[52] U.S. Cl. ..... 40/2 R; 40/16 E; 40/10 D

[58] Field of Search ..... 40/2 R, 16, 23 A, 10 D; 283/18, 21, 81

*Primary Examiner*—Gene Mancene
*Assistant Examiner*—Wenceslao J. Contreras
*Attorney, Agent, or Firm*—George E. Kersey; Barry D. Josephs

[57] ABSTRACT

A two-sided insert for transparent identification tabs. The insert has lateral side-by-side panels. This permits collinear entry of information on the panels. The adjoining panels are then folded back to back and inserted into an identification tab holder.

2 Claims, 5 Drawing Figures

INSERTS FOR TRANSPARENT IDENTIFICATION TABS

This is a continuation of Ser. No. 330,615, filed 12/14/81, now abandoned.

BACKGROUND OF THE INVENTION

This invention relates to inserts for transparent identification tabs and more particularly to caption bearing inserts for such tabs.

An "identification tab" is an appendage for a folder or divider. The purpose of the tab is to receive caption bearing inserts that serve to identify the materials associated with the folder or divider.

Ordinary inserts for tabs require that an entry for one side of each tab be made on one side of the insert, which is then reversed and a mirror image entry made on the other side of the tab. The insert is then folded about its major axis and inserted into the tab so that the entry appears on both sides of the transparent shell forming the tab. This procedure is time-consuming and inconvenient. It requires that the insert be reversed in the typewriter or other machine that is used in printing the insert information.

Accordingly, it is an object of the invention to facilitate the preparation of inserts for tabs. A related object is to avoid the need for reversing the insert in an imprinter in order to provide the desired identification information on opposite sides of the insert.

SUMMARY OF THE INVENTION

In accomplishing the foregoing and related objects the invention provides an insert which is foldable along a minor axis as opposed to the major axis of fold which characterizes the prior art. This kind of tab permits the desired information to be entered by an imprinter, such as a typewriter, on opposite sides of the final insert without requiring that the insert be removed and reversed in the typewriter. As a result the insert can be introduced into the typewriter, and two side-by-side entries made, separated by the minor axis along which folding takes place prior to introduction of the insert into an identification tab.

In accordance with another aspect of the invention the axis of fold can be asymmetric so that when the folding takes place there is an overlap region on one face of the insert that can be used for color coding related effects.

DETAILED DESCRIPTION

Figure 1A:
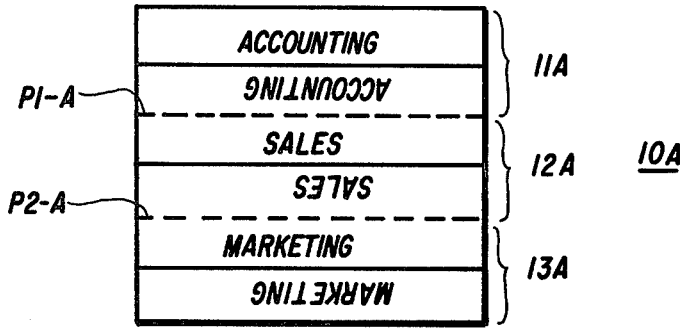
FIG. 1A is a diagram of a set of caption inserts in accordance with the prior art.

With reference to the drawings, FIG. 1A shows a set 10A of conventionally captioned inserts. The illustrative set 10A of FIG. 1A includes three individual inserts 11A, 12A and 13A. Adjoined inserts such as 11A and 12A are separable by lines of perforation P1-A and P2-A.

Figure 2A:
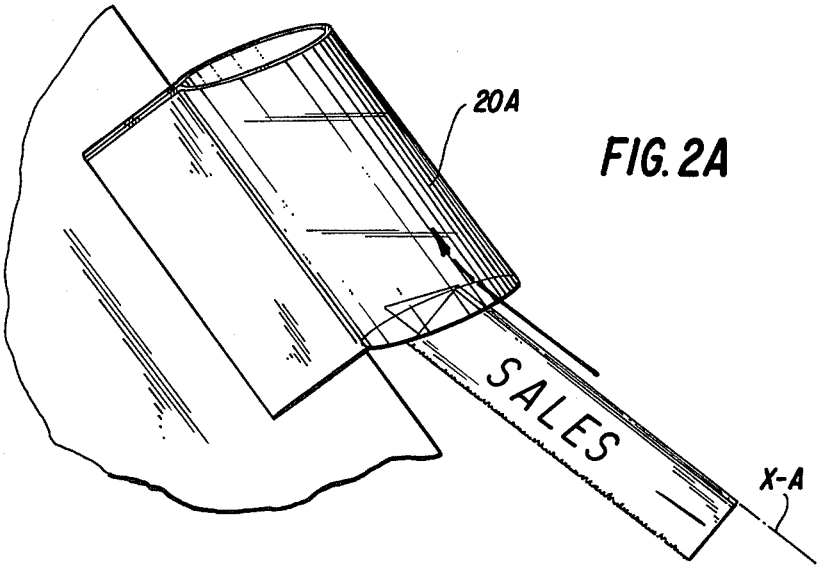
FIG. 2A is a perspective view showing the procedure for inserting individual caption inserts of FIG. 1A in accordance with the prior art.

In the use of the inserts the desired caption is entered on one portion of the insert, for example the upper portion of insert 11A. The set is then reversed and the caption introduced in reverse on the bottom portion. The insert is then separated from the remainder of the set 10A along the perforation lines P1-A. The insert is then folded about its major axis X-A and inserted into a transparent tab such as the tab 20A of FIG. 2A.

Figure 1B:
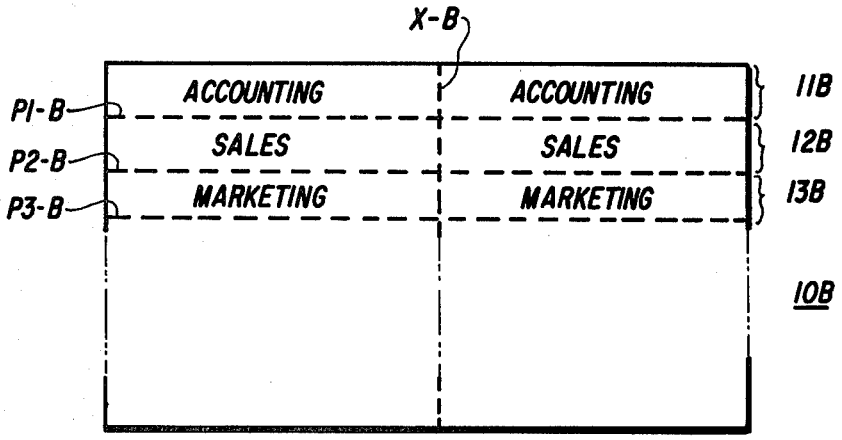
FIG. 1B is a set of caption inserts in accordance with the invention.

The difficulties and objections associated with the inserts of FIG. 1A are overcome in accordance with the invention by the set 10B of FIG. 1B. Illustratively the set 10B is made up of three successive inserts 11B, 12B and 13B. The insert set 10B of FIG. 1B facilitates the entry of the desired caption information. As illustrated the set 10B is readily insertable into a typewriter and opposing captions are typed on the same line of print, separated only by the minor axis X-B. There is therefore no need to remove the set 10B from the machine and reverse it as was the case with the prior art set 10A of FIG. 1A.

Figure 2B:
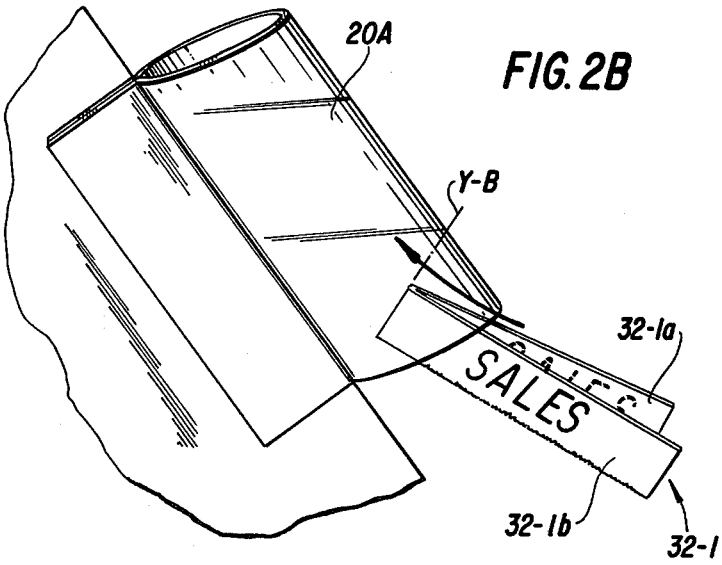
FIG. 2B is a perspective view showing the procedure for inserting individual caption inserts of FIG. 1A in accordance with the invention.

In using the set 10B the illustrative insert 11B is separated from the adjoining inserts of the set along a line of perforation P1-B. The insert is then folded about it minor axis X-B as shown in FIG. 2B.

Figure 3:
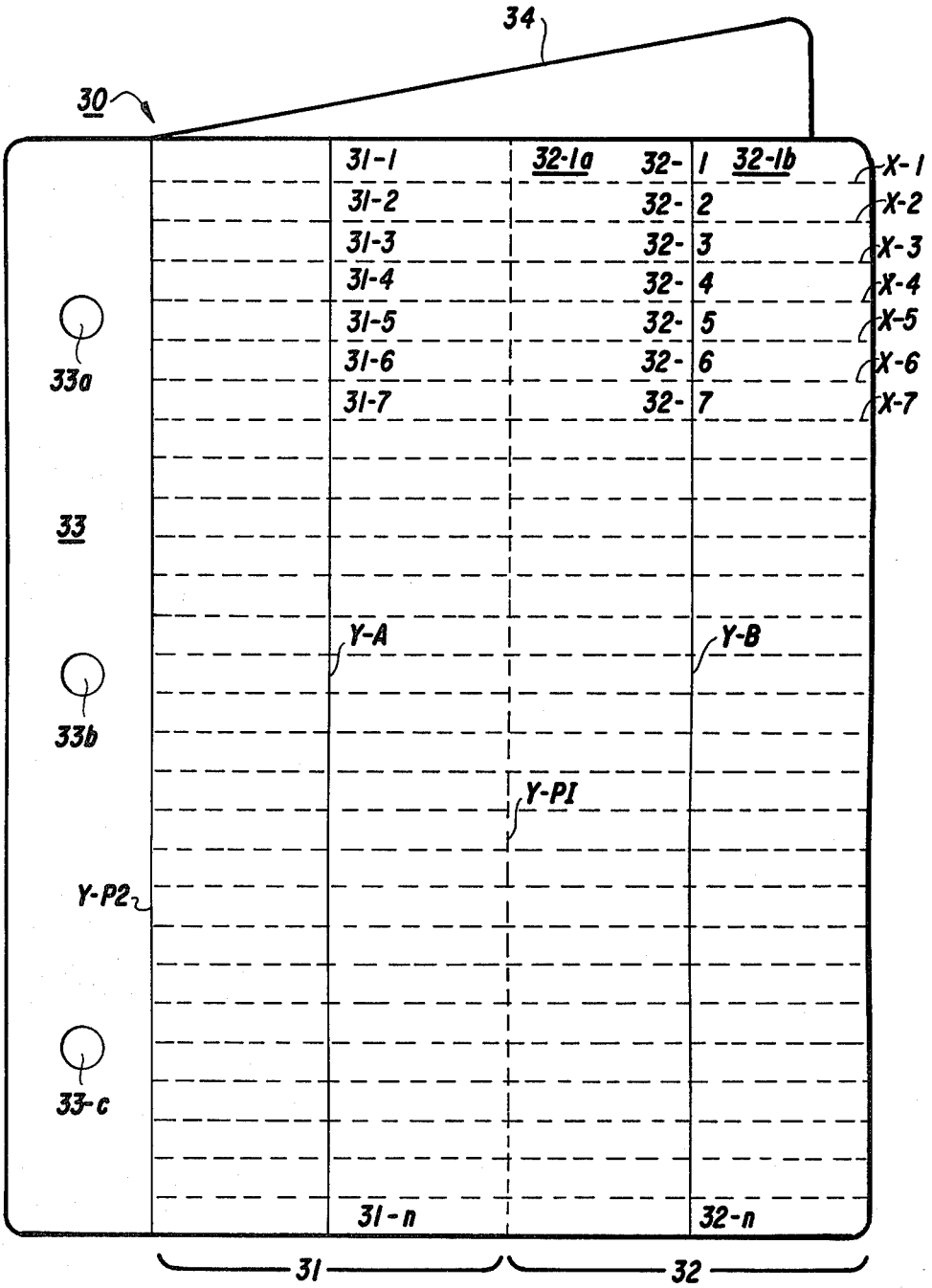
FIG. 3 is a set of caption inserts in accordance with the invention for accompanying a conventional package of dividers.

The invention readily lends itself to a set 30 of caption inserts as shown in FIG. 3. The set 30 includes two columns of inserts 31 and 32 that are separated by a vertical line of perforation Y-PI.

Within each column 31 and 32 are successive vertical inserts 31-1 thru 31-n for column 31 and 32-1 thru 32-n for column 32. The inserts are separated by successive horizontal lines of perforation X-1 thru X-N.

In addition, the inserts of each column 31 and 32 have respective fold lines Y-A and Y-B. The left margin 33 of the set 30 constitutes a support which is insertable, for example, into a notebook by retention apertures **33-*a* thru 33-*c*. It will be apparent that the set 30** is intended for insertion into a conventional three-ring binder. It will be apparent that the set may have more or fewer retention apertures according to the binder with which it is intended to be used.

Moreover, the panel 33 is desirably of reinforced material, such as Mylar® and the inserts are detachable from it along a line of perforation Y-P2.

It is desirable for the inserts to be color coded. Thus, the inserts 31-1 and 32-1 are red; the inserts 31-2 and 32-2 are orange; etc.

In use of the set 30, it is introduced, illustratively, into a typewriter and captions are printed on the horizontal side-by-side panels of, for example, panels **32-1*a* and 32-1*b* of the insert 32-1. The set 30 is removed from the typewriter and the insert 32-1 is separated from it along the vertical perforation lines Y-P1 and the horizontal perforation lines X-1. The insert 32-1** is next folded along its minor axis (of the fold line Y-B), in the fashion shown in FIG. 2B and inserted into an identification tab.

To retain the integrity of the set 30, after one or more individual inserts have been removed, it is desirable for it to be accompanied by a backing sheet 34 that is secured to the margin 33 and is inserted into the typewriter with the inserts that remain after one or more have been used and detached.

The backing sheet 34 may be of the release type and the inserts coated with pressure sensitive adhesive.

It is also apparent that the fold lines Y-A and Y-B may also be perforated.

In addition to facilitating the entry of information of inserts, the invention has the following further advantages:

1. Since the inserts are folded back to back along a minor axis they are more securely gripped and retained within, for example, the identification tap of FIG. 1A than for the prior art inserts illustrated in FIG. 2A.

2. Inserts in accordance with the invention also are easier to replace and remove, when the occasion requires, than in the prior art. Since inserts according to the invention are folded along a minor axis which provides a closed end which is perpendicular to the axis of the passage within the tab, they are easily removed when necessary by simply being pushed out by, for example, using a replacement tab which is pushed against the vertical fold. This contrasts markedly with the difficulty of the type shown in FIG. 2A where the fold is against the upper countour of the tab, making the removal of the insert comparably difficult.

While various aspects of the invention have been set forth by the drawings and specification, it is to be understood that the foregoing detailed description is for illustration only and that various changes, as well as the substitution of equivalent constituents shown and described may be made without departing from the spirit and scope of the invention as set forth in the appended claims.

I claim:

1. A two-sided insert for an identification tab which comprises a member having a minor axis and panels on each side of said minor axis for receiving caption information;

said insert being foldable along said minor axis to permit the introduction of the desired caption information in each of the panels without removing the insert from an imprinter that is used to form the captions.

2. An insert as defined in claim 1 wherein the information of the second panel is repetition of the information of the first panel and is displaced therefrom beyond said minor axis.

* * * * *